US008650835B2

(12) United States Patent
Sandor

(10) Patent No.: US 8,650,835 B2
(45) Date of Patent: Feb. 18, 2014

(54) INDICIA-APPLYING METHOD AND APPARATUS

(75) Inventor: Michael Sandor, Eau Claire, WI (US)

(73) Assignee: Presto Absorbent Products, Inc., Eau Claire, WI (US)

( * ) Notice: Subject to any disclaimer, the term of this patent is extended or adjusted under 35 U.S.C. 154(b) by 347 days.

(21) Appl. No.: 13/116,638

(22) Filed: May 26, 2011

(65) Prior Publication Data

US 2012/0297731 A1 Nov. 29, 2012

(51) Int. Cl.
*B65B 61/02* (2006.01)

(52) U.S. Cl.
USPC ..... 53/131.2; 493/321; 493/188; 493/53; 53/131.4

(58) Field of Classification Search
USPC ..... 53/131.2, 131.4; 493/53–55, 188
See application file for complete search history.

(56) References Cited

U.S. PATENT DOCUMENTS

| | | | | |
|---|---|---|---|---|
| 4,033,254 | A | 7/1977 | Tobey et al. | |
| 4,560,293 | A | 12/1985 | McCumber et al. | |
| 5,127,211 | A | 7/1992 | Mancini | |
| 5,251,988 | A | 10/1993 | Frazier | |
| 5,315,927 | A | 5/1994 | Yeh | |
| 5,666,785 | A | 9/1997 | Jouffreau et al. | |
| 5,810,487 | A | 9/1998 | Kano et al. | |
| 5,884,451 | A | 3/1999 | Kano et al. | |
| 6,045,278 | A | 4/2000 | Kubatzki et al. | |
| 6,102,536 | A * | 8/2000 | Jennel | 347/100 |
| 6,164,040 | A | 12/2000 | Bowman, Jr. et al. | |
| 6,173,551 | B1 | 1/2001 | Bowman, Jr. et al. | |
| 6,338,479 | B1 | 1/2002 | Van Der Werff et al. | |
| 6,729,103 | B1 | 5/2004 | Hartness et al. | |
| 6,739,110 | B2 | 5/2004 | Ogden et al. | |
| 7,156,605 | B1 | 1/2007 | Hadley et al. | |
| 7,331,158 | B2 | 2/2008 | Mantell et al. | |
| 8,419,601 | B2 * | 4/2013 | Harrington | 493/53 |
| 2003/0124471 | A1 | 7/2003 | Ishii et al. | |
| 2009/0211201 | A1 | 8/2009 | Frei | |
| 2009/0290961 | A1 | 11/2009 | Langston | |
| 2010/0060693 | A1 | 3/2010 | Sugahara | |
| 2010/0083615 | A1 | 4/2010 | Till | |
| 2010/0192517 | A1 | 8/2010 | Schach | |
| 2010/0263333 | A1 | 10/2010 | Langen | |

FOREIGN PATENT DOCUMENTS

| | | | |
|---|---|---|---|
| DE | 19740395 | A1 | 3/1999 |
| EP | 1435296 | A1 | 7/2004 |
| WO | WO-2013009397 | A1 | 1/2013 |

OTHER PUBLICATIONS

"International Application Serial No. PCT/US2012/039271, International Search Report mailed Sep. 7, 2012", 3 pgs.
"International Application Serial No. PCT/US2012/039271, Written Opinion mailed Sep. 7, 2012", 3 pgs.

* cited by examiner

*Primary Examiner* — Hemant M Desai
(74) *Attorney, Agent, or Firm* — Schwegman, Lundberg & Woessner, P.A.

(57) ABSTRACT

A carton processing apparatus and method can be used to reduce inventory of pre-printed or pre-labeled cartons. The carton processing apparatus can use a stacked inventory of unassembled cartons in a first planar orientation. A carton can be picked from the inventory, rotated from the first planar orientation to a print plane, and transported near a carton coding device, such as an ink jet printer, which can apply indicia to the carton. The processed carton can be further rotated or provided to a downstream device or process.

20 Claims, 12 Drawing Sheets

INDICIA-APPLYING METHOD AND APPARATUS

BACKGROUND

Packaging materials such as cartons come in countless shapes, sizes, and materials. Cardboard cartons, in particular, are in widespread use for containing everything from raw materials to finished goods, such as diapers, foodstuffs, books, or appliances, and various things in between.

Many cartons contain some sort of printed graphic or text to indicate source or origin, or to identify carton contents. In some scenarios, pre-printed cartons can arrive at a manufacturer's point of production. The manufacturer can fill the pre-printed cartons, and ship the filled cartons to customers. In other scenarios, substantially blank cartons can arrive at the manufacturer's point of production. The manufacturer can fill the substantially blank cartons, label the cartons, and ship the filled and labeled cartons to customers.

Carton information can be applied to a carton as a step in a manufacturing production line. For example, an operator can apply a stamp or place an adhesive-backed label to a cardboard carton, such as to indicate carton weight or contents. In an automated production line scenario, a filled carton can pass an automatic labeling device, such as a printer, to have carton information applied to the carton.

Several methods and apparatus have been developed seeking to optimize the application of carton information to cartons in an automated packaging environment, but such methods and apparatus have fallen short. For example, Bowman et al., in U.S. Pat. No. 6,164,040, entitled "CARTONER WITH INK JET CODER," refers to dispensing cartons along a single plane pathway past multiple ink jet print heads to apply carton information. As another example, Sugahara, in U.S. Patent Application No. 2010/0060693, entitled "PRINTER," refers to a printing apparatus that can print on a first surface of a printing medium, turn the medium upside down, and print on a rear surface.

OVERVIEW

A carton processing apparatus and method can be used to reduce inventory of pre-printed or pre-labeled cartons. The carton processing apparatus can be configured to use a stacked inventory of substantially unassembled cartons in a first planar orientation. An unassembled carton can be picked from the inventory, rotated from the first planar orientation to a print plane, and transported near a carton coding device, such as an ink jet printer, which can apply indicia including information to the carton. The indicia-bearing carton can be further rotated or otherwise provided to a downstream device or process.

This patent document describes, among other things, apparatus, methods, machine-readable media, or other techniques that can involve receiving one or more substantially unassembled carton blanks, manipulating a substantially unassembled carton blank, such as to orient a carton blank in a print plane, applying indicia to a substantially unassembled carton blank, and optionally further manipulating a substantially unassembled carton blank. The techniques can involve receiving a series of carton blanks, such as to provide a substantially constant supply of indicia-bearing cartons to a downstream device or process, such as an automated carton assembly or carton packing device.

The techniques described and illustrated herein can be directed toward optimizing a manufacturing process and reducing an inventory of pre-printed or pre-labeled cartons. In previous examples, a manufacturer oftentimes purchased pre-printed cartons from a carton supplier for containing a particular line of goods. If the particular line of goods was to be supplied to several different customers, and each customer had its own carton labeling requirements, the manufacturer was required to purchase several different pre-printed cartons from the carton supplier. Thus, the present inventor has recognized, among other things, that a problem to be solved can include reducing an inventory of pre-printed or pre-labeled cartons. The present subject matter can provide a solution to this problem, such as by applying carton indicia to a substantially unassembled blank carton at a point of production. For example, carton indicia, such as to designate carton contents and destination information, can be applied to a carton immediately before the carton is filled and sent to an export area. In an example, a substantially unassembled blank carton can be retrieved from a carton inventory, rotated from a horizontal plane to a vertical plane, and coded, such as using a printing or labeling device. In an example, the carton inventory can include a magazine of substantially horizontally oriented, unassembled cardboard cartons.

This Overview is intended to provide non-limiting examples of the present subject matter. It is not intended to provide an exclusive or exhaustive explanation. The Detailed Description is included to provide further information about the present subject matter.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
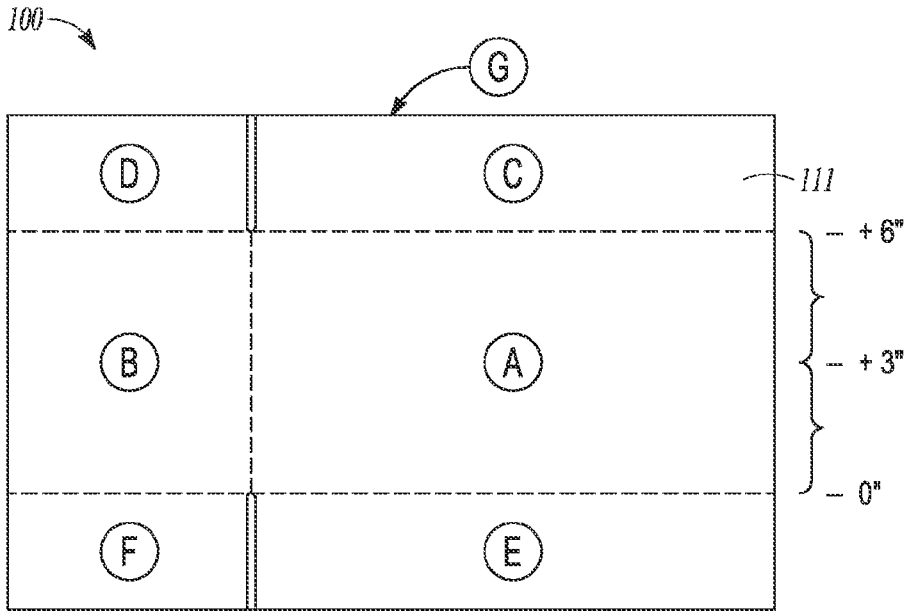
FIGS. 1A and 1B illustrate generally examples of a packaging carton and its component surfaces.
Figure 1B:
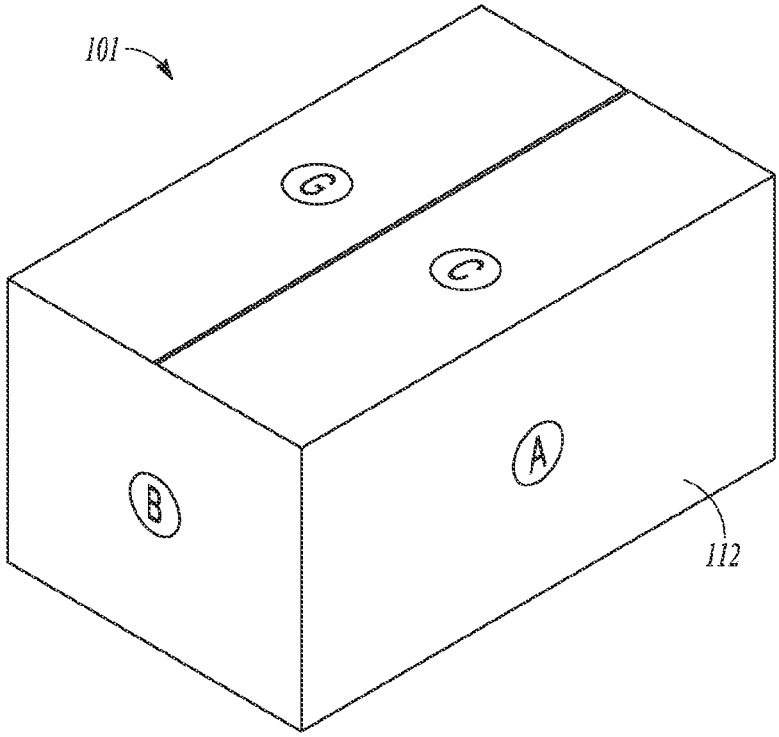

FIGS. 1A and 1B illustrate generally examples of a packaging carton. FIG. 1A illustrates generally an example of an unassembled carton 111, such as a cardboard carton or box that, when assembled, can substantially retain contents. In this document, the term "unassembled" as it relates to a carton is used to refer to an unexpanded carton and/or a carton that is coupled along an edge or corner, but which lies substantially flat in a planar configuration. That is, when an unassembled carton 111 is formed into an assembled carton 112, the assembled carton 112 can have four sides, a sealable bottom, and a sealable top. In the example of FIG. 1A, the carton 111 can have at least four faces and eight flaps. The faces A and B can form exterior side walls of the carton when assembled. The flaps D and F can be interior flaps of the carton when assembled. The flaps C and E can be exterior flaps of the carton when assembled. In an example, the unassembled carton 111 can have dimensions of about 3 by 2 by 0.05 feet. In an example, the unassembled carton 111 can have dimensions of about 3 by 2 by 0.02 inches. The present invention can be configured to process cartons and other substantially flat substrates that are larger or smaller than these dimensions.

FIG. 1B illustrates generally an example of an assembled carton 112. The assembled carton 112 can be formed from the unassembled carton 111. For example, the faces A and B, and the flap C in FIG. 1B can correspond to the faces A and B, and the flap C in FIG. 1A.

The assembled carton 112 can include carton indicia on any one or multiple sides of the carton. Carton indicia can include information such as the contents of the carton, the manufacturer of the carton contents, the manufacturer of the carton, the origin of the carton contents, address information, bar code information, or practically any other information that can be represented using text or graphics. Such carton indicia can be printed directly on to the carton substrate (e.g., cardboard, paperboard, plastic, etc.). In an example, carton indicia can be printed on an intermediate substrate, such as a label, for application to a carton.

Unique carton indicia can be applied to each carton in a series of unassembled cartons 111 or assembled cartons 112. For example, actual net weight information can be applied to each of a series of cartons, such as after the cartons are filled with different amounts of a particular product. In an example, unique carton indicia can be applied to each of a series of cartons such as to designate different contents.

Figure 2:
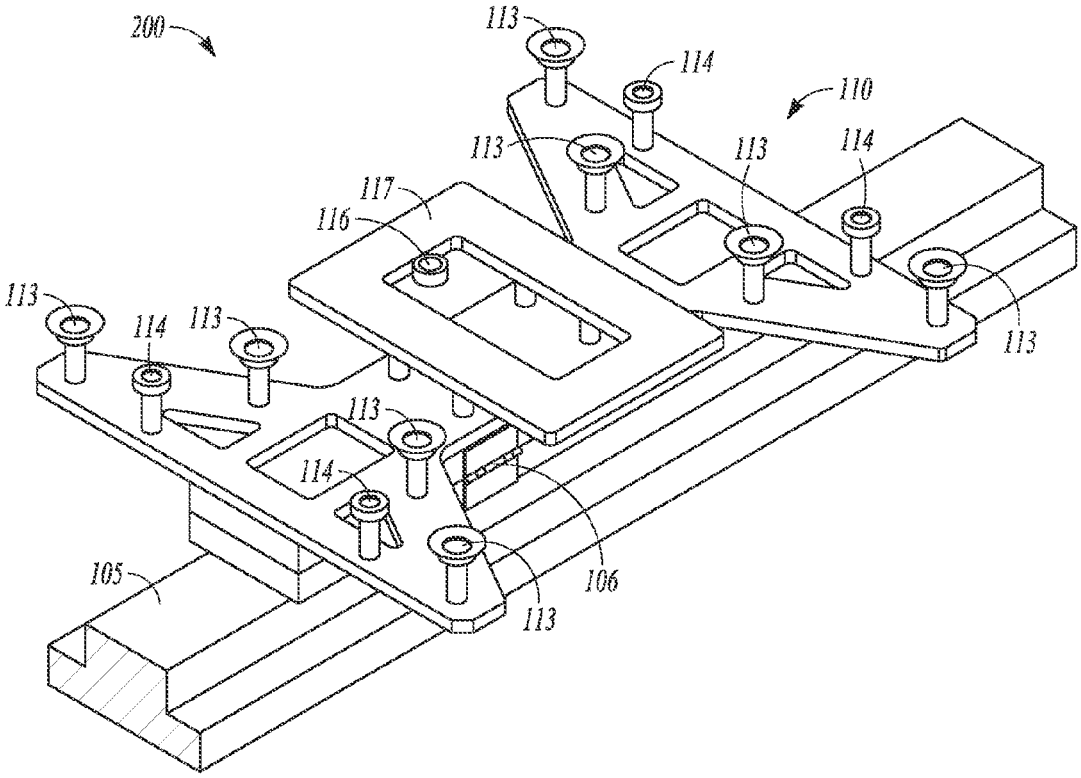
FIG. 2 illustrates generally a portion of an apparatus that can include a carton transport device.

FIG. 2 illustrates generally a portion of an apparatus 200 that can include a carton transport device 110. The carton transport device 110 can be configured to retrieve, receive, or retain a carton, such as a cardboard carton (e.g., the unassembled carton 111) or other substantially flat substrate. The carton transport device 110 can include one or more suction devices 113, peripheral positioners 114, or a central positioner 117. The carton transport device 110 can include a hinge 106, such as to permit rotation of a top portion of the carton transport device 110. In an example, the carton transport device 110 can include a sensor 116. In an example, the carton transport device 110 can be movably coupled with a track and conveyor 105.

In an example, the carton transport device 110 can include a suction device 113. The suction device 113 can include a vacuum-actuated suction cup, such as can be used to adhere to uneven or porous surfaces like cardboard or paperboard. Multiple suction devices 113 can be included on the carton transport device 110, such as to accommodate various lift force requirements. For example, a large unassembled carton 111 (e.g., a 36 ounce carton) can be transported using the carton transport device 110 with two or more suction devices 113. The lift force of the suction device 113 can be influenced by the diameter of the suction cup, the strength of the actuating vacuum, or the suction cup material, among other variables. The suction device 113 can include an elastic level adjustment, such as to compensate for uneven carton surfaces. In an example, one or more suction devices can be configured to contact a carton face, such as one or more of the carton faces A or B on the unassembled carton 111 of FIG. 1A.

In an example, the carton transport device 110 can include the peripheral positioner 114 or the central positioner 117. The peripheral positioner 114 can include a rubber stopper, and several peripheral positioners can be used with the carton transport device 110, such as in several different locations, to substantially brace a carton or other substrate (e.g., the unassembled carton 111). For example, peripheral positioners 114 can be located in several locations corresponding with the flaps of the unassembled carton 111, such as to prevent the flaps from moving or folding during carton transport. The central positioner 117 can be similarly used to brace a carton or other substrate, such as in a central portion of the unassembled carton 111 (e.g., at carton face A). In an example, the peripheral positioners 114 or the central positioner 117 can be a moderate durometer (e.g., 70 Shore A) rubber material, and can have a diameter of about 1 inch.

The carton transport device 110 can include a sensor 116. The sensor 116 can include an optical sensor or a mechanical sensor, among other sensors, such as can be configured to detect the presence of a carton on the carton transport device 110. For example, the sensor 116 can be an optical sensor configured to provide an electrical signal when a carton (e.g., the unassembled carton 111) obstructs light from reaching the sensor 116. The sensor 116 can be a mechanical sensor configured to physically actuate when a carton (e.g., the unassembled carton 111) is coupled to the carton transport device 110, such as subsequent to vacuum-actuation of the suction devices 113.

The carton transport device 110 can include a hinge 106. The hinge 106 can enable at least a portion of the carton transport device 110, such as a top portion, to rotate. The unassembled carton 111 can be coupled to the carton transport device 110, such as using the suction devices 113. The top portion of the carton transport device 110 can be continuously rotatable, such as from an initial orientation to a non-coplanar second orientation. Consequently, the unassembled carton 111 coupled to the carton transport device 110 can be rotated, such as from an initial planar orientation (e.g., a horizontal orientation) to a second planar orientation (e.g., a vertical orientation).

A lower portion of the carton transport device 110 can be coupled with a track and conveyor 105. The track and conveyor 105 can be configured to carry the carton transport device 110 along a path, such as a substantially linear path. Other paths including bends, turns, or changes in elevation along the track can also be used. In an example, the track and conveyor 105 can include a linear track and motor. The motor can include a brushless servo motor, such as with an encoder to provide information about a location of the carton transport device 110. The motor can be configured to transport the carton transport device 110 along the track and conveyor 105, such as at a substantially constant velocity. The carton transport device 110 can be transported along the track and conveyor 105 in any orientation, such as a horizontal, vertical, or intermediate angled orientation. The motor can be coupled to the track or the carton transport device 110.

In an example, the track can include a linkage or a belt drive. In some examples, multiple carton transport devices 110 can be disposed on the track, which can be formed into a continuous loop. In such an example, one or more carton transport devices 110 can be fixedly coupled to the track, and the track can be driven by a track motor, such as in a tank-wheel configuration.

The hinge 106 can enable a portion of the carton transport device 110 to rotate in a direction perpendicular to a direction of travel of the carton transport device 110. For example, where the track and conveyor 105 include a substantially linear track (e.g., a horizontal track), the rotatable portion of the carton transport device 110 can rotate about a direction perpendicular to the length of the track.

In an example, the carton transport device 110 can use a non-hinged mechanism to rotate the entire carton transport device 110 or a portion of the carton transport device 110, such as perpendicular to a direction of travel. For example, a pneumatic or hydraulic manipulation mechanism can be used to lift or adjust a top portion of the carton transport device 110, such as in a rotational direction. In an example, the track and conveyor 105 can include a turn or twist, such as parallel to the direction of travel. The carton transport device 110 can be fixedly coupled to the track and conveyor 105 and can travel along the turned or twisted track and conveyor 105. Consequently, the carton transport device 110 can be rotated, such as by a rotational amount that is the same as the rotational turn or twist of the track and conveyor 105.

Figure 3:
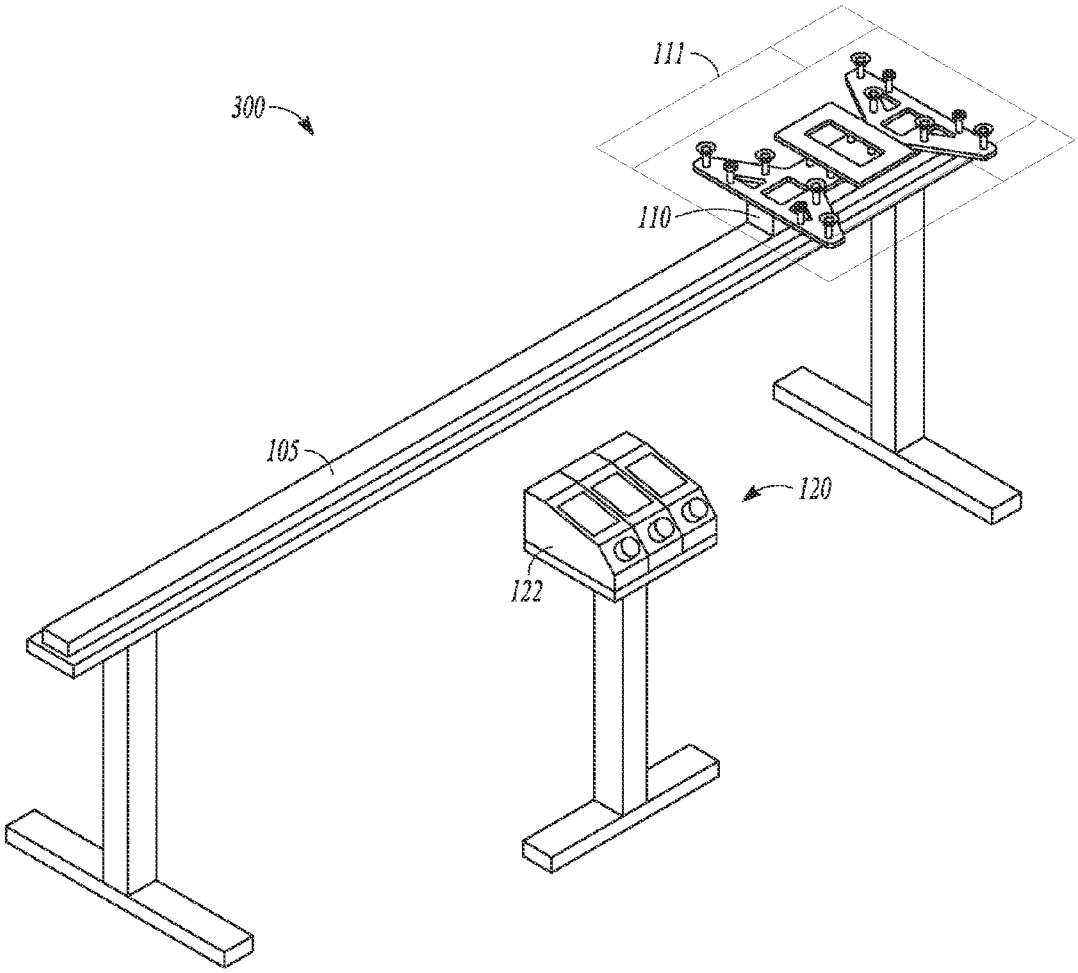
FIG. 3 illustrates generally a portion of an apparatus that can include a carton transport device in a first orientation and a carton coding device.

FIG. 3 illustrates generally a portion of an apparatus 300 that can include the carton transport device 110 in a first rotational orientation and a carton coding device 120. The carton transport device 110 can be coupled to the track and conveyor 105, such as including a substantially linear track. The unassembled carton 111 can be coupled to the carton transport device 110, such as in a horizontal orientation. The carton transport device 110 can carry the unassembled carton 111 from at least one end of the track to an opposite end.

In an example, the carton transport device 110 can carry the unassembled carton 111 near the carton coding device 120. The carton coding device 120 can include one or more devices operable to apply information to a substrate (e.g., the unassembled carton 111) carried by the carton transport device 110. For example, the carton coding device 120 can include one or more print heads, such as an impact print head (e.g., a dot matrix print head), a thermal ink print head, an ink jet print head (such as including an integral or piezo print head), a drum print head, or a laser print head, among others. The one or more print heads can have the same or different characteristics, including resolution, speed, color capacity, and memory, among others.

In an example, the carton coding device 120 can be a label application device. For example, the carton coding device 120 can be an automatic label applicator, such as can be used to apply pre-printed labels to the unassembled carton 111 or other substrate. The carton coding device 120 can include a label application device that can print label information on to a label just prior to the label application. In some carton processing examples, such as where very porous or very smooth carton substrate surfaces are used, labeling a carton or other substrate with an adhesive-backed label can be more effective than applying ink directly to the substrate surface.

In the example of FIG. 3, the carton coding device 120 can include at least two ink jet print heads 122. The ink jet print heads 122 can be independently positioned, such as in a horizontal or vertical plane. In an example, a first ink jet print head 122 can print in multiple colors (e.g., cyan, magenta, etc.) over a first area (e.g., 3 inch height) at a first resolution (e.g., 180 dots per inch (dpi)). A second ink jet print head 122 can similarly print in multiple colors over the first area at the first resolution. One or more additional print heads can be included, such as can be configured to print with different colors, over different areas, or at different resolutions.

In an example, the first ink jet print head 122 can be configured to apply indicia over a first portion of a carton, such as from a bottom edge of a carton (e.g., a location 0 inches in FIG. 1A) to an intermediate portion of a carton face (e.g., a location +3 inches in FIG. 1A). The second ink jet print head 122 can be configured to print a second portion of the carton, such as from the intermediate portion of the carton face (e.g., the location +3 inches in FIG. 1A) to an upper print edge of a carton (e.g., the location +6 inches in FIG. 1A). In an example, the first and second ink jet print heads 122 can be configured to print over the same portion of a carton (e.g., the first portion of a carton), such as using different colors or types of ink, or at different resolutions.

Figure 4:
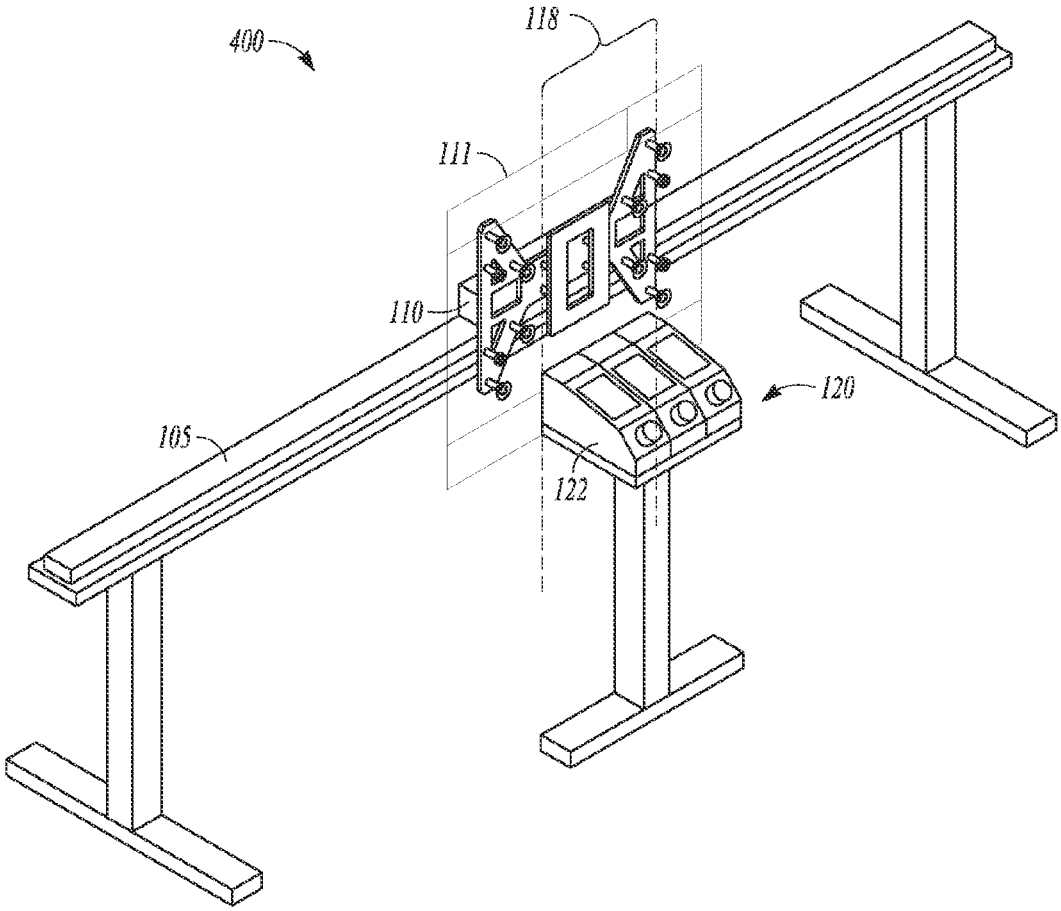
FIG. 4 illustrates generally a portion of an apparatus that can include a carton transport device in a second orientation and a carton coding device.

FIG. 4 illustrates generally a portion of an apparatus 400 that can include the carton transport device 110 in a second orientation and the carton coding device 120. In an example, the ink jet print heads 122 can be configured to print in a plane that is different than an initial plane of the unassembled carton 111. For example, the ink jet print heads 122 can be configured to print in a substantially vertical plane, and an initial plane of the unassembled carton 111 can be a substantially horizontal plane. To accommodate the configuration of the print heads, the unassembled carton 111 can be rotated from an initial orientation (e.g., a horizontal orientation) to a vertical orientation, such as using the carton transport device 110 and the hinge 106.

In an example, a top portion of the carton transport device 110 can be configured to rotate while the carton transport device 110 is at rest or in motion. For example, the carton transport device 110 can begin in a first orientation (e.g., a substantially horizontal orientation) and can accelerate along the track and conveyor 105, such as until a print velocity is reached. The carton transport device 110 can rotate its top portion, such as to a vertical orientation, while the carton transport device 110 is at rest, accelerating, or after attaining a print velocity.

In an example, a top portion of the carton transport device 110 can be fully rotated from a horizontal to a vertical orientation before a leading edge of the unassembled carton 111, such as coupled to the carton transport device 110, enters a print region 118. The print region 118 can include an area wherein the ink jet print heads 122 can be configured to apply carton indicia to the passing unassembled carton 111. The carton transport device 110 can be configured to rotate the top portion to return to an initial (e.g., horizontal) orientation after the ink jet print heads 122 have applied the carton indicia to the unassembled carton 111, such as after a trailing edge of the unassembled carton 111 exits the print region 118.

In an example, carton location information can be used to determine when or if the top portion of the carton transport device 110 can be rotated. For example, an encoder coupled to the track and conveyor 105 can provide the carton location information to the carton transport device 110. Mechanical or optical sensors, such as at or near the carton coding device 120, can provide the location information to the carton transport device 110. A combination of encoder information and sensor information can be used to provide the carton location information and to indicate if the top portion of the carton transport device 110 can be rotated, such as without interfering with another portion of the carton processing device.

Figure 5:
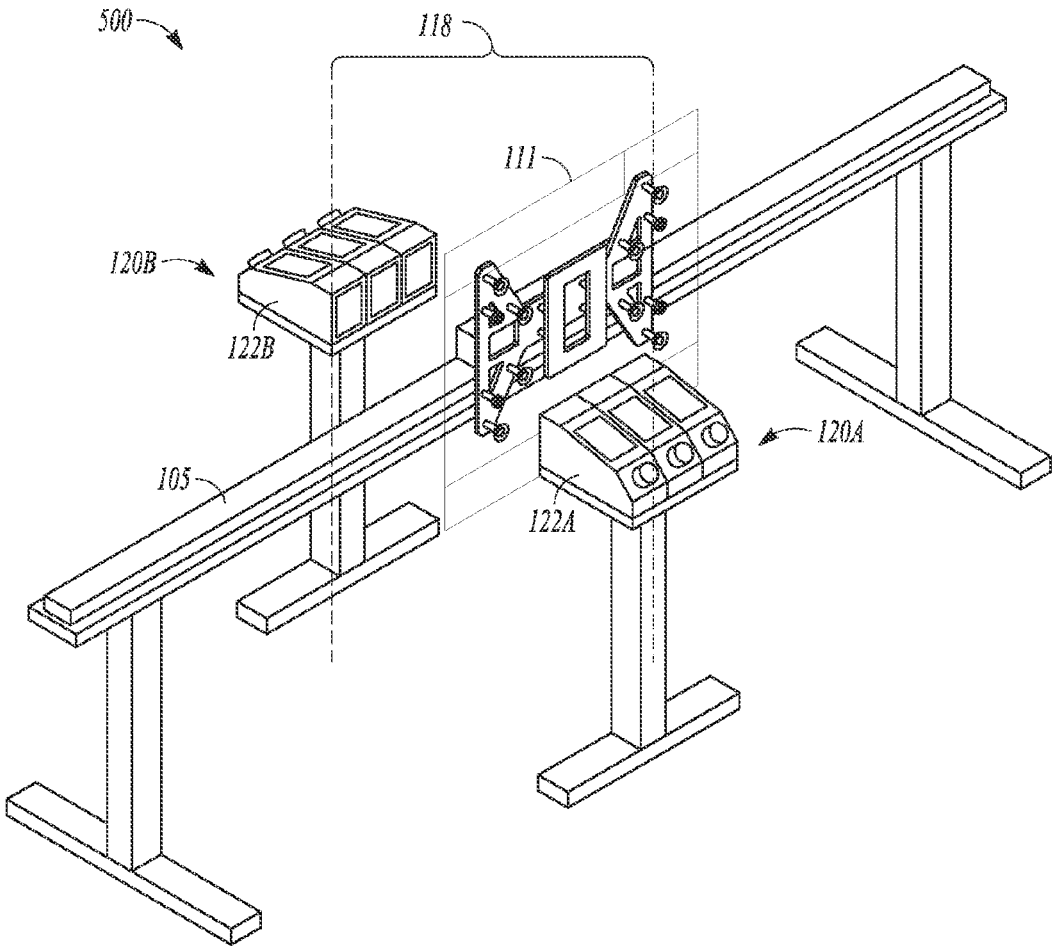
FIG. 5 illustrates generally a portion of an apparatus that can include a carton transport device and multiple carton coding devices.

FIG. 5 illustrates generally a portion of an apparatus 500 that can include the carton transport device 110 and multiple carton coding devices. For example, the apparatus 500 can include all of the features of the apparatus 400, including a first carton coding device 120A and a second carton coding device 120B. The first and second carton coding devices 120A and 120B can include ink jet print heads 122A and 122B, respectively. The first and second carton coding devices 120A and 120B can include other types of printing or coding devices, such as can be used to apply carton indicia to a carton or other substrate.

In the example of FIG. 5, the carton transport device 110 can be configured to carry the unassembled carton 111 through the print region 118 when the unassembled carton 111 is in a substantially vertical orientation. The print region 118 can include any area over which the first and second carton coding devices 120A and 120B are capable of applying carton indicia to the unassembled carton 111. For example, the first carton coding device 120A can be configured to apply carton indicia to a first side of the unassembled carton 111 (e.g., faces A and B, and flaps C, D, E, and F in FIG. 1A) and the second carton coding device 120B can be configured to apply carton indicia the an opposite side of the unassembled carton 111.

In the example of FIG. 5, the first and second carton coding devices 120A and 120B can be placed on opposite sides of the track and conveyor 105 and the carton transport device 110. The first carton coding device 120A can be configured to apply carton indicia to face A of the unassembled carton 111, and the second carton coding device 120B can be configured to apply carton indicia to flap G of the unassembled carton 111 (see, e.g., FIGS. 1A and 1B). In an example, the first and second carton coding devices 120A and 120B can be placed on the same side of the track and conveyor 105 and the carton transport device 110, such as to print on only one side of the unassembled carton 111. The first carton coding device 120A can be configured to print over a lower portion of the unassembled carton 111 (e.g., flaps E and F) and the second carton coding device 120B can be configured to print over an upper portion of the carton (e.g., flaps C and D). Thus, the printable area of the carton can be extended by adding additional carton coding devices.

Figure 6:
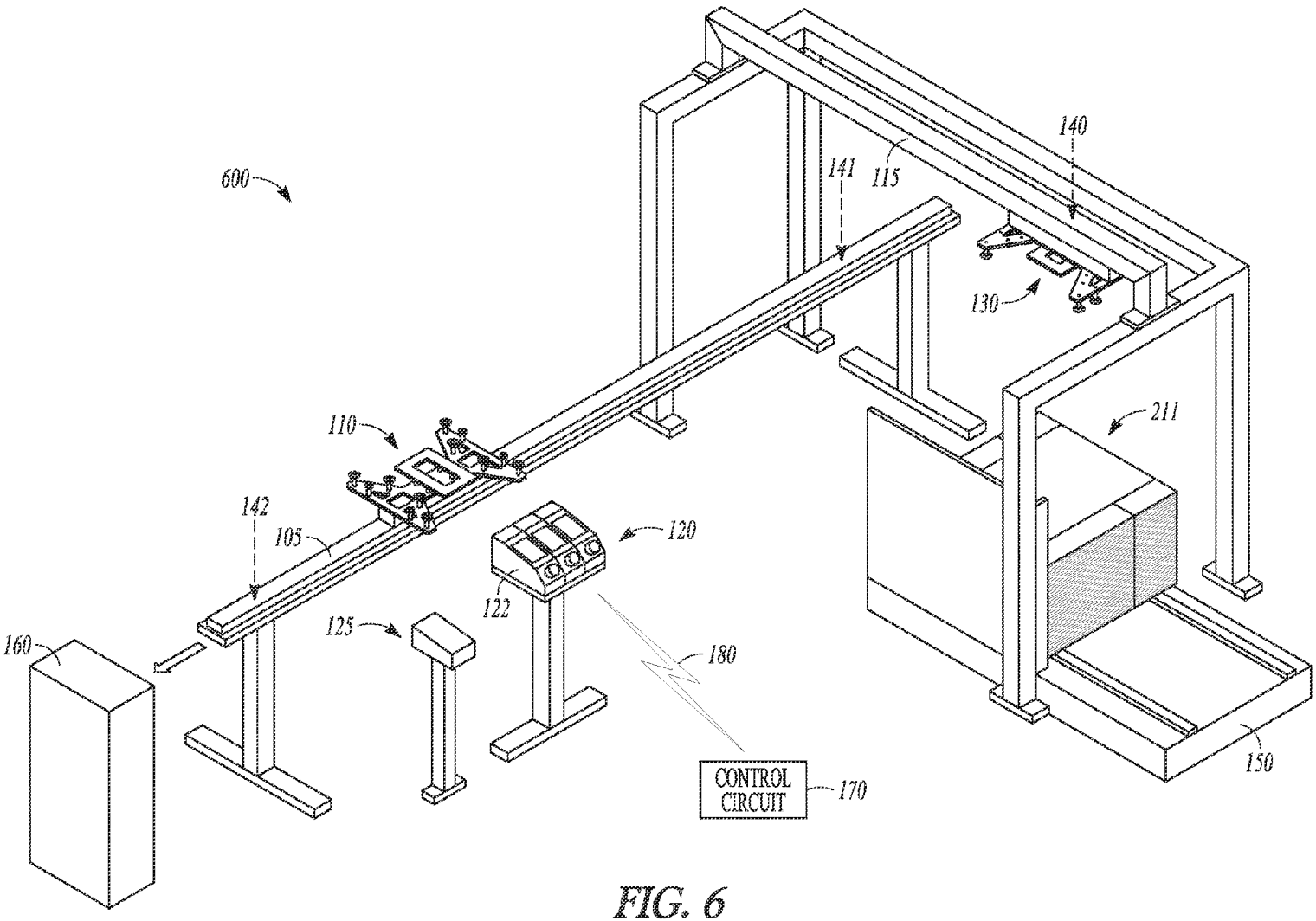
FIG. 6 illustrates generally a portion of an apparatus that can include a carton transport device and a carton coding device for use with a carton inventory holder.

FIG. 6 illustrates generally a portion of an apparatus 600 that can include the carton transport device 110, the carton coding device 120, and a carton inventory holder 150. The apparatus 600 can include a complete carton processing apparatus, wherein an inventory of carton blanks 211 can be received at an input portion of the apparatus, and a processed carton (e.g., a carton containing carton indicia) can be provided at an output portion of the apparatus. The output portion of the apparatus can include a downstream device or process 160, such as an automatic carton assembly device, or a second carton inventory.

In the example of FIG. 6, the carton inventory holder 150 can include an inventory of carton blanks 211, such as including a stack of one or more unassembled cartons (e.g., including the unassembled carton 111). In an example, the carton inventory holder 150 can include an inventory of carton blanks 211 such as including a magazine of substantially assembled cartons. In an example, the apparatus 600 can be configured to process any substrate that can be held in the carton inventory holder 150, such as can include substrates with at least one substantially planar portion, such as including substantially flat sheets of paper, cardboard, or plastic, among other materials. The carton inventory holder 150 is further discussed below in the discussion of FIG. 7.

The carton inventory holder 150 and the inventory of carton blanks 211 can be accessed using a carton retrieval transport device 130. The carton retrieval transport device 130 can include some or all of the features of the carton transport device 110, such as including the suction device 113, the peripheral positioner 114, the central positioner 117, the hinge 106, or the sensor 116, among other features. The carton retrieval transport device 130 can be transported in a first plane (e.g., a horizontal plane) along a retrieval track and conveyor 115, such as can be similar to the track and conveyor 105. The carton retrieval transport device 130 can be further transported in a second plane (e.g., a vertical plane), such as using a pneumatic cylinder or other mechanical transport device. For example, in a carton pick-up position 140, the carton retrieval transport device 130 can be located substantially above the inventory of carton blanks 211. The carton retrieval transport device 130 can be lowered in a vertical direction using the pneumatic cylinder such that the suction devices 113 can contact a first carton blank, such as an unassembled carton blank (e.g., the unassembled carton 111). Vacuum actuation of the suction devices 113 can secure the unassembled carton blank to the carton retrieval transport device 130. The carton retrieval transport device 130 and the attached unassembled carton blank can then be transported, such as to a carton handoff position 141.

In an example, the handoff position 141 can be a position where the carton retrieval transport device 130 is positioned substantially above the carton transport device 110, such that the unassembled carton blank can be transferred from the carton retrieval transport device 130 to the carton transport device 110. The carton retrieval transport device 130 can be actuated in a vertical direction, such as to bring the unassembled carton blank down to the carton transport device 110. The carton transport device 110 can also be movable in a vertical direction, such as to facilitate a handoff at the handoff position 141. The carton retrieval transport device 130 can return to the carton pick-up position 140, such as after releasing the unassembled carton blank to the carton transport device 110.

After the unassembled carton blank is transferred to the carton transport device 110, such as at the handoff position 141, carton indicia can be applied to the carton, such as using the apparatus 400 or the apparatus 500. In the example of FIG. 6, a verification device 125 can be used to verify the applied carton indicia, such as the carton indicia applied using the carton coding device 120. The verification device 125 can be disposed along the track and conveyor 105 subsequent to the carton coding device 120.

The carton coding device 120 can be configured to print bar code information on a first face of the unassembled carton 111. The verification device 125 can be configured to verify the readability of the bar code, such as immediately after the carton coding device 120 applies the bar code information. The verification device 125 can be any sort of optical scanner, including any machine vision scanner capable of recognizing text, graphics, or other printed codes or indicia.

In an example, the carton transport device 110 and an attached carton can be transported along the track and conveyor 105 to a terminal carton position 142, such as subsequent to the print region 118. The processed carton can be provided to a downstream device or process 160 for subsequent printing, assembly, or other manipulation or processing.

In an example, the processed carton can be provided to a second carton inventory using a second carton retrieval transport device that can effectively mirror the carton retrieval transport device 130. For example, the second carton retrieval transport device can be configured to receive the processed carton (e.g., the unassembled carton 111 including the carton indicia applied by the carton coding device 120) at the terminal carton position 142. The second carton retrieval transport device can, for example, transport the carton to an inventory of processed cartons, such as a stacked inventory of cartons with printed carton indicia. In an example, the inventory of processed cartons can be collected using a processed carton inventory holder 152 (see FIG. 8) that can functionally mirror the carton inventory holder 150.

The apparatus 600 can be controlled at least in part using a control circuit 170. The control circuit 170 can include a processor circuit, and a processor-readable medium including instructions to operate the apparatus 600. In an example, the processor-readable medium can include instructions to operate the apparatus 600 according to the examples of FIGS. 9-13. The control circuit 170 can be communicatively coupled to any one or more of the elements of the apparatus 600, among other elements, such as using a communicative data coupling 180. The discussion of FIG. 8, below, further describes the interface of the control circuit 170 with the elements of the apparatus 600.

Figure 7:
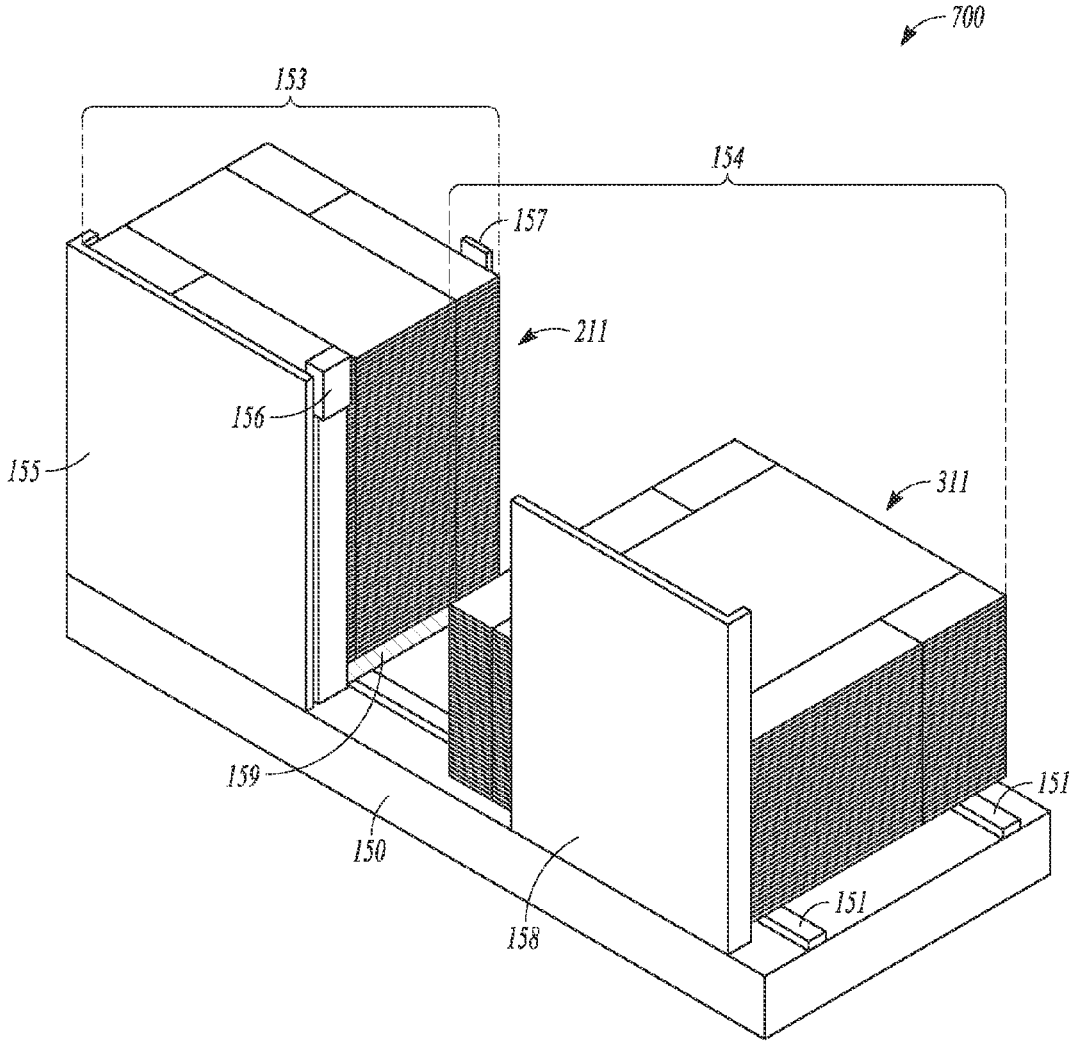
FIG. 7 illustrates generally a portion of an apparatus that can include a carton inventory holder.

FIG. 7 illustrates generally a portion of an apparatus 700 that can include the carton inventory holder 150. In an example, the carton inventory holder 150 can include an operational portion 153 and a staging portion 154. The operational portion 153 can include a stack of one or more unassembled carton blanks, such as the inventory of carton blanks 211. The operational portion 153 can be located at the carton pick-up position 140 to facilitate an exchange of a blank carton from the inventory to the carton retrieval transport device 130.

In an example, the inventory of carton blanks 211 can be disposed on a carton riser 159 that can be used to maintain an upper planar edge of the inventory of carton blanks 211. For example, when the inventory of carton blanks 211 is at full capacity, the carton riser 159 can be retracted such that the inventory of carton blanks 211 does not rise above a particular horizontal plane. As the inventory of carton blanks 211 is depleted, such as during operation of the apparatus 600, the carton riser 159 can elevate the inventory of carton blanks 211 to maintain the uppermost carton blank in the particular horizontal plane. The particular horizontal plane can include a plane from which the carton retrieval transport device 130 is configured to retrieve a carton from the inventory of carton blanks 211.

The operational portion 153 of the carton inventory holder 150 can include several carton positioning features. For example, the operational portion 153 can include an operational carton inventory alignment wall 155, a first carton aligner 156, and a second carton aligner 157. These three alignment features can be used to secure and maintain an initial carton alignment, such as of an uppermost carton in the inventory of carton blanks 211. The carton retrieval transport device 130 and the carton transport device 110 can maintain the initial carton alignment such that no additional carton alignment adjustments are required prior to an application of the carton indicia (e.g., using the carton coding device 120). Various sensors (e.g., the sensor 116, such as an optical sensor) can be used to verify carton alignment, such as before the control circuit 170 instructs the carton retrieval transport device 130 to retrieve a carton from the inventory of carton blanks 211.

In an example, the staging portion 154 of the carton inventory holder 150 can include carton alignment features such as a staging carton inventory alignment wall 158. The staging portion 154 can maintain a secondary carton blank inventory 311, such as can be used to replenish the inventory of carton blanks 211. For example, when a final carton blank is removed from the inventory of carton blanks 211 (e.g, as determined using the control circuit 170 and the sensor 116), the secondary carton blank inventory 311 can be advanced from the staging portion 154 to the operational portion 153 of the carton inventory holder 150. The secondary carton blank inventory 311 can be automatically advanced using the carton inventory track 151, such as can be controlled by the control circuit 170. Thus, the secondary carton blank inventory 311 can be loaded on to the fully retracted carton riser 159, and can be aligned using the operational carton inventory alignment wall 155, and the first and second carton aligners 156 and 157. In an example, the secondary carton blank inventory 311 can be manually or automatically replenished at any time.

In an example, the operational portion 153 and the staging portion 154 can maintain inventories of similarly or differently sized cartons or other substrates. The control circuit 170 can be used to adjust features of the apparatus, such as to accommodate changes from a first carton shape to a second carton shape. For example, the secondary carton blank inventory 311 can include cartons that differ in size, shape, or weight from an exhausted inventory of carton blanks 211. When the secondary carton blank inventory 311 advances to the operational portion 153, the control circuit 170 can adjust, among other elements, the carton pick-up position 140, or the suction devices 113 of one or more of the carton retrieval transport device 130 or the carton transport device 110, to accommodate the change in carton inventory (e.g., the vacuum applied to the suction devices 113 can be increased to accommodate a heavier carton).

Figure 8:
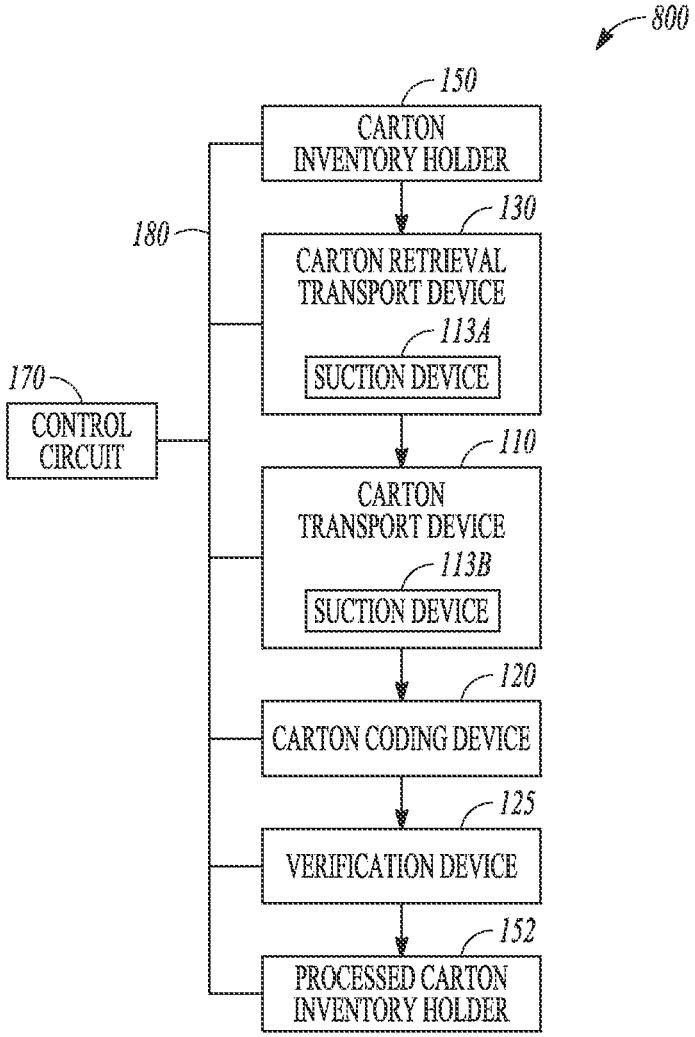
FIG. 8 illustrates generally a block diagram that can include a carton processing device and a control circuit.

FIG. 8 illustrates generally a block diagram that can include a carton processing apparatus 800. In the example of FIG. 8, the control circuit 170 can be communicatively coupled to any one or more of the carton inventory holder 150, the carton retrieval transport device 130, the retrieval track and conveyor 115, the track and conveyor 105, the carton transport device 110, the carton coding device 120, the verification device 125, the downstream device or process 160, the processed carton inventory holder 152, or the suction devices 113A or 113B, among other devices. The control circuit 170 can be communicatively coupled to other devices, such as can be configured to interface with the apparatus 600, including an air supply (e.g., to supply the vacuum to actuate the suction devices 113), or a process flow controller to determine when the carton retrieval transport device 130 can retrieve a carton from the carton inventory holder 150, or when to provide a processed carton to the downstream device or process 160.

In an example, the control circuit 170 can be communicatively coupled with a carton indicia driver, such as can be used to provide instructions to the carton coding device 120 about the information to be applied to one or a series of cartons. The carton indicia driver can provide unique information (e.g., a serial number) to each carton in a series. For example, the carton indicia driver can provide unchanging information to be applied to each carton in a batch of cartons. In an example, the control circuit 170 can be coupled to one or more other devices using the communicative data coupling 180, such as using a wireless data communication coupling, or a wired data communication coupling (e.g., CAT V).

Figure 9:
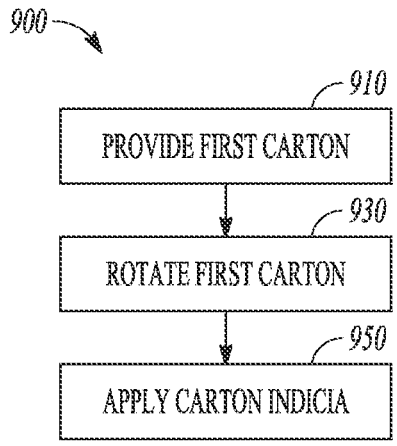
FIG. 9 illustrates generally an example that can include applying information to a carton.

FIG. 9 illustrates generally an example 900 that can include applying carton indicia to a carton. In an example, a first carton can be received at 910. The first carton can be received from the inventory of carton blanks 211, such as using the carton retrieval transport device 130. In an example, the first carton can be manually received by the carton transport device 110. The first carton can be received in any orientation, such as a horizontal orientation. For example, the first carton can be the unassembled carton 111, and it can be received by a top surface of the carton transport device 110. The first carton can be secured to the carton transport device 110 using the suction device 113. The first carton received at 910 can be retained by the carton transport device 110, such as according to the discussion of FIGS. 2 and 3.

At 930, the first carton can be rotated. In an example, the first carton can be rotated using a rotatable portion of the carton transport device 110, such as a hinged top portion of the carton transport device 110. The first carton can be rotated by any amount, such as by a few rotational degrees or by 90 degrees or more. The extent of the rotation can be determined by the functional limitations of a carton transport hinge (e.g., the hinge 106) or the track and conveyor 105, among other functionally limited devices. See, for example, the discussion at FIG. 2 regarding the rotation of the carton transport device 110.

In an example, the first carton can be rotated at 930 from an initial orientation (e.g., a horizontal carton orientation) to a print orientation (e.g., an orientation that is the same as or different than the initial orientation, such as a vertical carton orientation). For example, the first carton can be rotated at 930 from the initial orientation illustrated generally in FIG. 3 to the different second orientation illustrated generally in FIG. 4.

In an example, the first carton can be rotated at 930 at a first rotational rate. The first rotational rate can be adjusted to minimize carton shifting and maximize carton throughput, such as through the carton processing apparatus 600. The rate can depend upon several features of the first carton, such as the carton weight, size, and shape. The rate can further depend upon several features of the carton transport device 110, or the track and conveyor 105, among other features. See, for example, the discussion at FIGS. 2, 3, and 4 regarding the functional elements of the carton transport device 110, and the rotation of the carton transport device 110.

At 950, carton indicia can be applied to the first carton. For example, carton indicia, such as including text or graphics, can be applied to the first carton (e.g., the unassembled carton 111) using the carton coding device 120. The carton indicia can be applied to the first carton when the first carton is in a different rotational orientation than an initial rotational orientation. The carton indicia can be applied using any of the carton coding devices described above, such as in the discussions of FIGS. 3 through 6.

In an example, carton indicia applied at 950 can be applied to at least one side of the unassembled carton 111. For example, the carton indicia can be applied to the carton faces A, B, and C, such that the carton indicia can appear on more than one side of the carton when assembled (see FIGS. 1A and 1B). Importantly, the carton indicia can be applied to a single plane of the of the unassembled carton 111, and the carton indicia can correspond to multiple different planes of the carton after assembly, such as including a first carton plane (e.g., occupied by carton face A), a second carton plane (e.g., occupied by carton face B), or a third carton plane (e.g., occupied by carton face C), among other carton planes.

Figure 10:
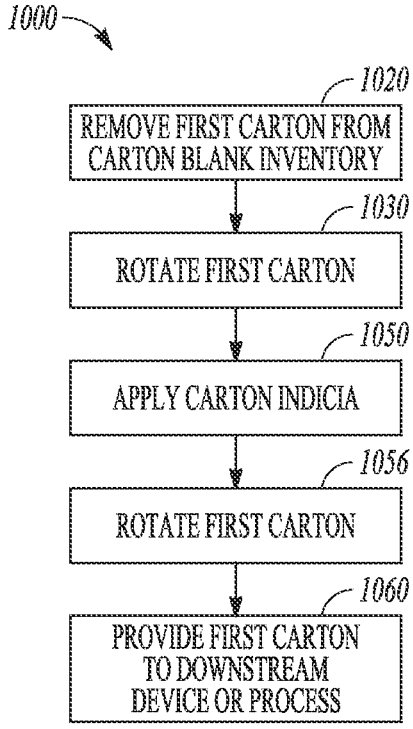
FIG. 10 illustrates generally an example that can include applying carton indicia to a rotated carton.

FIG. 10 illustrates generally an example 1000 that can include applying carton indicia to a rotated carton. In an example, a first carton can be removed from a carton blank inventory at 1020. For example, the first carton (e.g., the unassembled carton 111) can be removed from the inventory of carton blanks 211 in the operational portion 153 of the carton inventory holder 150. The first carton can be removed using the carton retrieval transport device 130, and can be transferred to the carton transport device 110 for further processing at the carton handoff position 141. In an example, the first carton can be removed using the carton transport device 110, or can be manually placed on the carton transport device 110. The first carton removed at 1020 can be in an initial carton orientation.

At 1030, the first carton can be rotated. The first carton can be rotated according to the discussion at 930, such as using the carton transport device 110. In an example, the first carton can be rotated at 1030 from an initial carton orientation to a print orientation that is substantially orthogonal to the initial orientation. At 1050, carton indicia can be applied to the first carton. The carton indicia can be applied according to the discussion at 950, such as using the carton coding device 120. In an example, the carton indicia can be applied while the carton transport device 110 carries the first carton through a print region (e.g., the print region 118) of one or more ink jet print heads 122 on the carton coding device 120.

At 1056, the first carton can be rotated. For example, where the first carton was rotated from an initial carton orientation to a print orientation at 1030, the first carton can be rotated to the initial carton orientation at 1056. In an example, the first carton can be rotated to a final orientation that is different than the initial orientation and the print orientation. A downstream device or process 160 can be configured to receive the first carton in an intermediate orientation, such as rotated 45 degrees from a vertical orientation. In such an example, the carton transport device 110 can be configured to rotate the first carton to 45 degrees at 1056. At 1060, the first carton can be provided to the downstream device or process 160, such as an automatic carton assembler or case packer.

Figure 11:
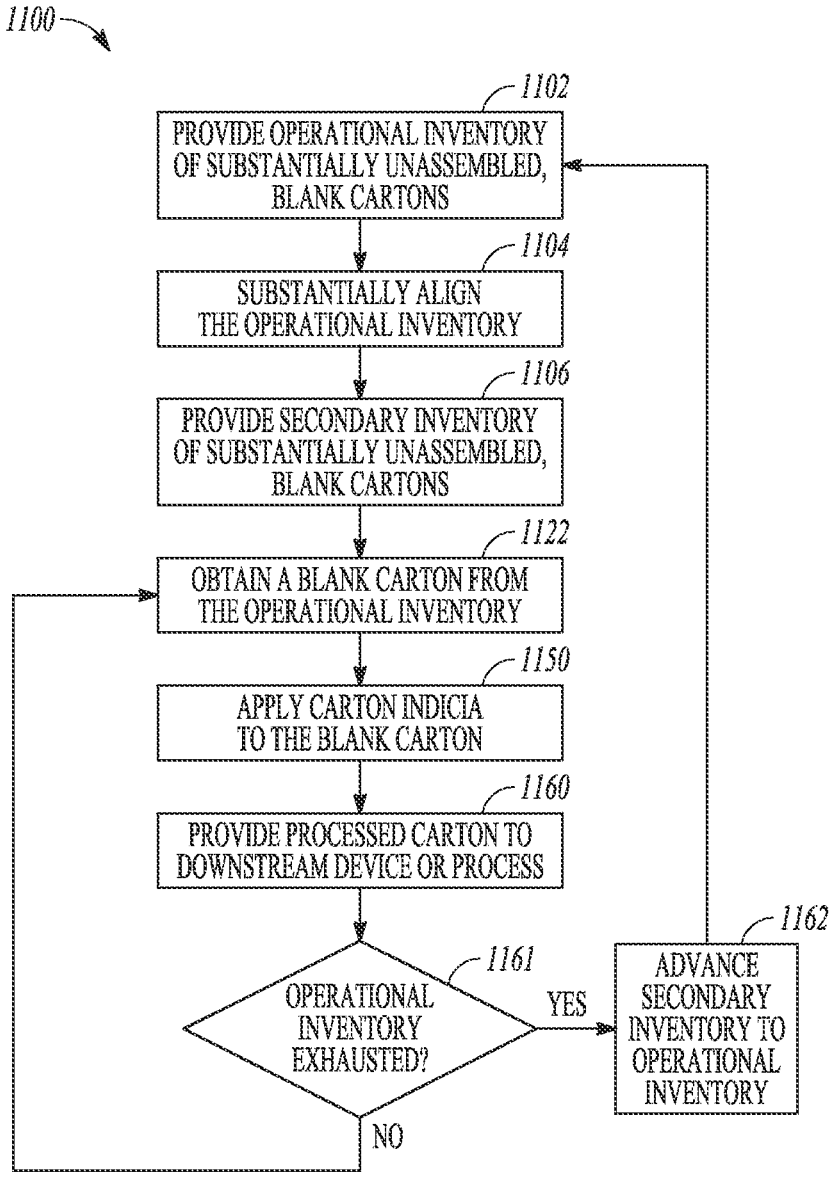
FIG. 11 illustrates generally an example that can include determining a status of an operational inventory of cartons.

FIG. 11 illustrates generally an example that can include determining a status of an operational inventory of cartons. In an example, FIG. 11 can describe a portion of the carton inventory holder 150 as shown in FIG. 7. At 1102, an operational inventory of unassembled, substantially blank cartons can be provided. The operational inventory can include the inventory of carton blanks 211, such as can be disposed in the operational portion 153 of the carton inventory holder 150. At 1104, the operational inventory can be substantially aligned, such as using the operational carton inventory alignment wall 155, the first carton aligner 156, or the second carton aligner 157, among other alignment devices. The operational inventory alignment can be verified, such as using a sensor coupled to one or more of the alignment devices, or using optical sensors to determine a carton position or carton inventory position. Information obtained or received from such sensors can be interpreted using the control circuit 170.

At 1106, a secondary inventory of unassembled, blank cartons can be provided. In an example, the secondary inventory can include the secondary carton blank inventory 311, such as can be disposed in the staging portion 154 of the carton inventory. The secondary inventory can be substantially aligned, such as using the staging carton inventory alignment wall 158. The operational inventory and the secondary inventory can include the same or different carton materials. For example, the operational inventory can include a stack of unassembled carton bottoms, and the staging inventory can include a stack of unassembled carton lids. In an example, the operational inventory and the secondary inventory can include a magazine of unassembled cartons 111, wherein the operational inventory includes cartons of a first size and weight, and the secondary inventory includes cartons of a different second size and weight.

At 1122, a blank carton can be obtained from the operational inventory. In an example, the blank carton can be obtained from the operational inventory such as from the inventory of carton blanks 211. The blank carton can be obtained from the top of a stack of unassembled cartons 111. The blank carton can be obtained using the carton retrieval transport device 130, and can be transferred to the carton transport device 110, such as at the carton handoff position 141, for further processing. In an example, the blank carton can be removed using the carton transport device 110, or can be manually placed on the carton transport device 110. The blank carton can be obtained at 1122 in an initial blank carton orientation.

At 1150, carton indicia can be applied to the blank carton, such as using the carton coding device 120. The carton indicia can be applied such as according to the discussion at 950. At 1160, the processed carton can be provided to the downstream device or process 160, such as according to the discussion at 1060.

At 1161, the operational inventory can be analyzed for remaining blank cartons. For example, the control circuit 170 can be configured to analyze the operational inventory for remaining blank cartons after each application of carton indicia to a blank carton. The control circuit 170 can be configured to determine the presence or absence of a blank carton, such as in the operational portion 153 of the carton inventory, using information from one or more sensors disposed near the operational inventory.

In an example, at 1161, the control circuit 170 can determine that the operational inventory is not exhausted, and that cartons remain in the inventory of blank cartons 211. Accordingly, the carton processing apparatus (e.g., the apparatus 600) can continue to operate, such as by obtaining a subsequent blank carton from the operational inventory at 1122. This process can repeat until the operational inventory is exhausted, or until some other intervention of the control circuit 170 or an operator.

In an example, at 1161, the control circuit 170 can determine that the operational inventory is exhausted, and that no cartons remain in the inventory of blank cartons 211. Accordingly, if a secondary carton blank inventory 311 is available, the secondary inventory can be advanced into the operational inventory position at 1162. For example, the secondary carton blank inventory 311 can be conveyed, such as along the carton inventory track 151, and placed upon the carton riser 159, such as to provide an operational inventory of unassembled, blank cartons at 1102. The carton riser 159 can elevate this newly-arrived carton blank inventory to an operational position, such as can be accessible by the carton retrieval transport device 130. One or more carton alignment devices (e.g., the first and second carton aligners 156 and 157) can be configured to automatically align the newly-arrived carton blank inventory, such as at 1104.

Figure 12:
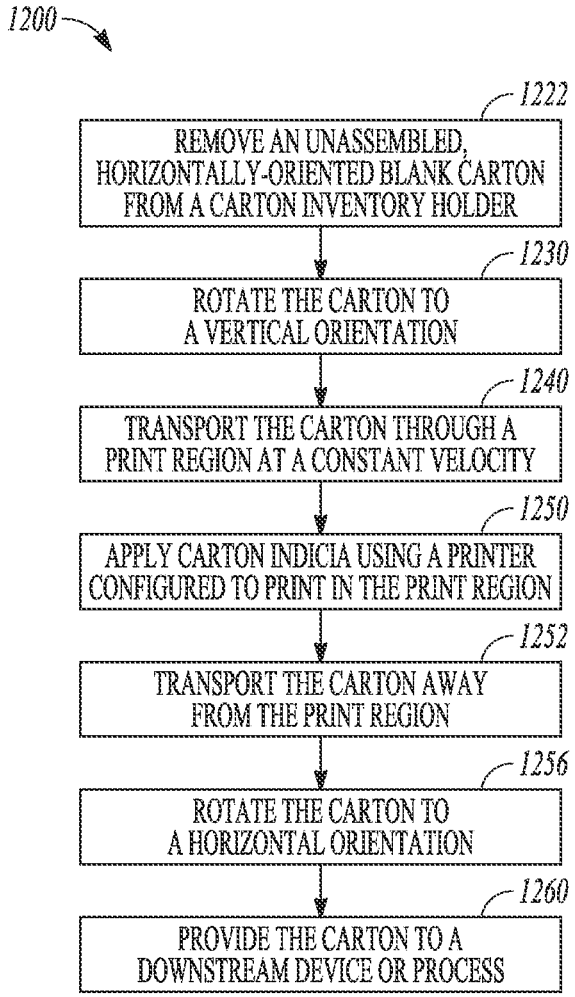
FIG. 12 illustrates generally an example that can include rotating a carton between horizontal and vertical orientations and applying information to the carton.

FIG. 12 illustrates generally an example that can include rotating a carton between horizontal and vertical orientations and applying information to the carton. In an example, an unassembled carton 111, such as oriented in a horizontal plane, can be removed from a carton blank inventory at 1222 (e.g., the inventory of carton blanks 211). Removing the horizontally-oriented unassembled carton 111 can be performed such as according to the discussion at 1022, such as using the carton retrieval transport device 130. At 1230, the unassembled carton 111 can be rotated to a vertical plane, such as using the hinged top portion of the carton transport device 110. The unassembled carton 111 can be coupled to the carton transport device 110, such as via a vacuum force provided via the suction device 113B, or via a grip force. The control circuit 170 can be configured to initiate or release a vacuum or grip force such as in response to information about a carton presence that can be received from the one or more sensors 116.

At 1240, the rotated, unassembled carton 111 can be transported through a print region (e.g., the print region 118) at a constant velocity, such as using the carton transport device 110 and the track and conveyor 105. In an example, at 1250, the carton coding device 120 can be configured to apply carton indicia to the unassembled carton 111 as it passes through the print region, such as at a constant velocity. In an example, the carton coding device 120 can be configured to apply carton indicia to the unassembled carton 111 during an acceleration or deceleration of the carton transport device 110 along the track and conveyor 105. Application of carton indicia at 1250 can be initiated using the control circuit 170, such as in response to receiving an indication of the presence of a carton in the print region.

At 1252, the processed carton (e.g., the unassembled carton with carton indicia) can be transported away from the print region, such as using the carton transport device 110. In an example, transporting the carton away from the print region can include verifying at least a portion of the carton indicia applied at 1250, such as using a verification device 125 (e.g., a bar code scanner). The processed carton can be transported away from the print region at a constant velocity or under some acceleration.

In an example, a trailing edge of the processed carton can be sensed exiting the print region using a sensor coupled to the control circuit 170. Once the trailing edge of the processed carton is detected, the processed carton can be rotated at 1256, such as to a horizontal orientation. The processed carton can be rotated to the horizontal orientation using the top rotatable portion of the carton transport device 110. At 1260, the rotated or processed carton can be provided to a downstream device or process 160, such as according to the discussion at 1060.

Figure 13:
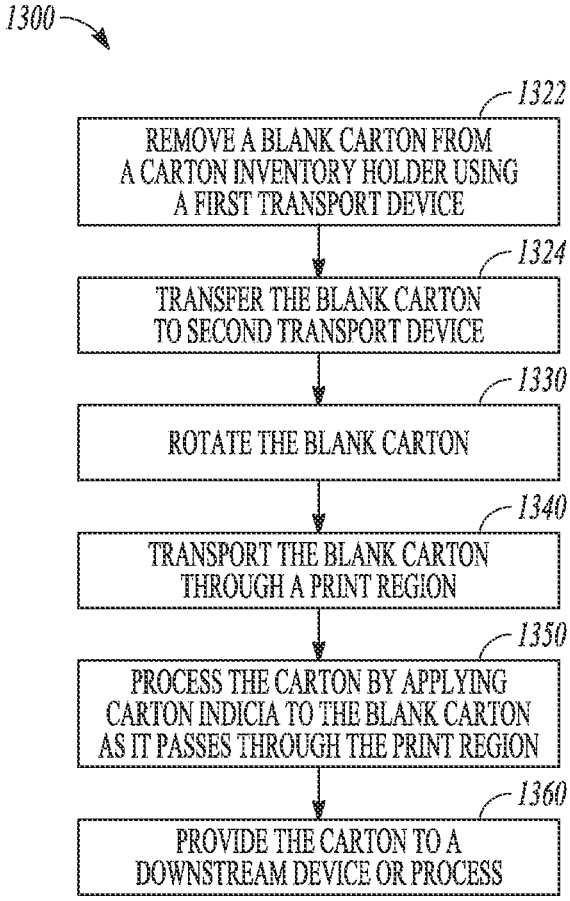
FIG. 13 illustrates generally an example that can include transporting a carton using more than one carton transport device.

FIG. 13 illustrates generally an example that can include transporting a carton using more than one carton transport device. In an example, FIG. 13 can illustrate a portion of the apparatus 600 as a flow chart. At 1322, a blank carton (e.g., the unassembled carton 111) can be removed from a carton inventory (e.g., the carton inventory holder 150, such as including the inventory of carton blanks 211) using a first transport device (e.g., the carton retrieval transport device 130). Some features of the first transport device are described above in the discussion of FIG. 2. In an example, the blank carton can be removed from the carton inventory holder 150 at the carton pick-up position 140.

At 1324, the blank carton can be transferred to a second transport apparatus, such as the carton transport device 110. The blank carton transfer can occur at the carton handoff position 141, such as when the carton retrieval transport device 130 is disposed substantially near the carton transport device 110, such that the suction devices 113 on the carton retrieval transport device 130 can release the blank carton, and the suction devices 113 on the carton transport device 130 can be actuated to receive and retain the blank carton. One or more sensors 116 can be used to verify a successful handoff of the blank carton between the transport devices.

At 1330, the blank carton can be rotated, such as according to the discussion at 930, such as using the devices described in FIGS. 2, 3, and 4. The blank carton can be transported through a print region (e.g., the print region 118) at 1340, such as according to the discussion at 1240. At 1350, carton indicia can be applied to the blank carton as it is transported through the print region, such as according to the discussion at 1250. The carton indicia applied at 1350 can include the application of a label to the blank carton. At 1360, the processed carton can be provided to a downstream device or process 160, such as according to the discussion at 1060.

Additional Notes & Examples

Example 1 includes subject matter, such as a method, comprising receiving an unassembled carton in a first planar orientation, rotating the unassembled carton from the first planar orientation to a second planar orientation, which is angled relative to the first planar orientation, transporting the unassembled carton at a velocity in a direction parallel or substantially parallel to the second planar orientation, and printing or labeling indicia on the unassembled carton while the carton is being transported. Example 1 can include subject matter such as the unassembled carton, which can be an unexpanded carton and/or a carton that is coupled along an edge or corner but which can lie substantially flat in a planar configuration. Example 1 can include subject matter such as receiving an unassembled carton using a carton transport device or apparatus, such as using a vacuum or grip force to couple the unassembled carton to the carton transport device.

In Example 2, the subject matter of Example 1 can optionally include rotating the unassembled carton with the indicia from the second planar orientation to an orientation parallel with the first planar orientation.

In Example 3, the subject matter of one or any combination of Examples 1-2 can optionally include receiving the unassembled carton by removing the unassembled carton from an inventory of one or more unassembled cartons. For example, the unassembled carton can be removed from an inventory holder.

In Example 4, the subject matter of one or any combination of Examples 1-3 can optionally include removing the unassembled carton from the inventory holder of one or more unassembled cartons, such as by removing the unassembled carton using a vacuum-actuated device coupled to a transport mechanism.

In Example 5, the subject matter of one or any combination of Examples 1-4 can optionally include removing the unassembled carton from the inventory holder of one or more unassembled cartons, such as by removing the unassembled carton from a stacked inventory of one or more horizontally-oriented unassembled cartons.

In Example 6, the subject matter of one or any combination of Examples 1-5 can optionally include placing the unassembled carton with the indicia in an inventory of printed or labeled unassembled cartons.

In Example 7, the subject matter of one or any combination of Examples 1-6 can optionally include providing the unassembled carton with the indicia to an automated carton assembly device.

In Example 8, the subject matter of one or any combination of Examples 1-7 can optionally include printing carton information on the unassembled carton such that, when assembled, the carton contains carton information on at least two different carton sides.

In Example 9, the subject matter of one or any combination of Examples 1-8 can optionally include rotating the unassembled carton from the first planar orientation to the second planar orientation, such as including rotating the unassembled carton from a horizontal orientation to a vertical orientation.

In Example 10, the subject matter of one Example 9 can optionally include printing carton information on the unassembled carton using an ink jet print head configured to print within a plane parallel to the second planar orientation.

In Example 11, the subject matter of one or any combination of Examples 1-10 can optionally include rotating the unassembled carton from the first planar orientation to the second planar orientation, including rotating the unassembled carton at least about 90 degrees.

In Example 12, the subject matter of one or any combination of Examples 1-11 can optionally include optically reading or verifying the indicia.

In Example 13, the subject matter of one or any combination of Examples 1-12 can optionally include printing or labeling indicia on the unassembled carton, including transporting the unassembled carton at a substantially constant velocity parallel to a print plane of one or more stationary print heads.

In Example 14, the subject matter of one or any combination of Examples 1-13 can optionally include subject matter, such as a method, comprising removing a carton, from an inventory of one or more unexpanded cartons, using a vacuum force, transporting the carton away from the inventory, rotating the carton from an initial plane to a print plane, wherein the print plane is non-parallel to the initial plane, transporting the carton through a print region, including printing indicia on the carton using at least one print head configured to print substantially within the print plane, and reading or verifying the printed indicia using an optical scanning device. Example 14 can include subject matter such as rotating the carton from the print plane to the initial plane or a plane parallel with the initial plane, or transporting the carton away from the printing region.

Example 15 includes subject matter, such as a carton processing apparatus, comprising a carton transport device or apparatus, including a carton retrieval device and a conveyor, the carton retrieval device rotatable between a first planar orientation and a second, non-coplanar orientation and movable, using the conveyor, between a first retrieval device location and a second retrieval device location spaced apart from the first retrieval device location. Example 15 can include subject matter such as a carton coding device configured to apply indicia to a surface of a carton retrieved and retained by the carton retrieval device, or a control circuit, communicatively coupled to the carton transport device, or apparatus, and the carton coding device, the control circuit configured to provide carton location information to the carton coding device.

In Example 16, the subject matter of Example 15 can optionally include the carton retrieval device, which can be configured to obtain an unassembled carton in the first planar orientation, and the carton coding device, which can be configured to apply the indicia to the unassembled carton while the carton retrieval device is in the second planar orientation.

In Example 17, the subject matter of one or any combination of Examples 15 or 16 can optionally include a carton coding device comprising one or more ink jet print heads.

In Example 18, the subject matter of one or any combination of Examples 15-17 can optionally include the carton transport device, or apparatus, which can be configured to carry the carton retrieval device in the second planar orientation, wherein the second planar orientation can be parallel to a printing plane of the one or more ink jet print heads.

In Example 19, the subject matter of one or any combination of Examples 15-18 can optionally include a conveyor that can comprise a substantially linear conveyor track configured to carry the carton retrieval device between the first retrieval device location and the second retrieval device location.

In Example 20, the subject matter of one or any combination of Examples 15-19 can optionally include a carton blank inventory holder, and the carton retrieval device can be configured to retrieve, in the first planar orientation, a carton blank from the carton blank inventory holder.

In Example 21, the subject matter of one or any combination of Examples 15-20 can optionally include a printed or labeled carton inventory holder, and the carton retrieval device can be configured to place a carton including applied indicia in the printed or labeled carton inventory holder.

In Example 22, the subject matter of one or any combination of Examples 15-21 can optionally include an optical verification device that can be configured to read or verify indicia applied by the carton coding device. In an example, the optical verification device can be communicatively coupled to the control circuit.

In Example 23, the subject matter of one or any combination of Examples 15-22 can optionally include an optical verification device, such as including a bar code scanner.

In Example 24, the subject matter of one or any combination of Examples 15-23 can optionally include a carton coding device that can be configured to apply unique indicia to multiple different cartons.

In Example 25, the subject matter of one or any combination of Examples 15-24 can optionally include a carton coding device that can be configured to apply indicia in the form of bar code information to a surface of a carton.

In Example 26, the subject matter of one or any combination of Examples 15-25 can optionally include a carton coding device that can be configured to apply indicia to at least one side of an unassembled carton.

In Example 27, the subject matter of one or any combination of Examples 15-26 can optionally include a carton transport device, or apparatus, that can be configured to provide an unassembled carton including applied indicia to an automatic carton assembly device.

In Example 28, the subject matter of one or any combination of Examples 15-27 can optionally include a second carton coding device. Example 28 can include subject matter such as the first carton coding device that can be configured to apply indicia to a first side of an unassembled carton, and the second carton coding device that can be configured to apply indicia to a second side of the unassembled carton.

In Example 29, the subject matter of one or any combination of Examples 15-28 can optionally include a carton retrieval device, such as comprising a vacuum-actuated device configured to retain a carton, such as a cardboard carton.

In Example 30, the subject matter of one or any combination of Examples 15-29 can optionally include a carton processing apparatus, comprising a first linear transport apparatus, including a first carton transport device and a first linear track, wherein the first linear track can be configured to carry the first carton transport device between a picking position and a handoff position. Example 30 can include a second linear transport apparatus, such as including a second carton transport device and a second linear track, wherein the second linear track can be configured to carry the second carton transport device between the handoff position and a release position, such as including through a print region. Example 30 can include subject matter such as a carton coding device that can be disposed in or near the print region, or a control circuit, such as can be communicatively coupled to any one or more of the carton coding device, the first linear transport apparatus, and the second linear transport apparatus.

In Example 31, the subject matter of one or any combination of Examples 15-30 can optionally include the second carton transport device, which can be configured to operate between an initial planar transport orientation, a print position planar transport orientation that is different from the initial planar transport orientation, and a final planar transport orientation.

In Example 32, the subject matter of one or any combination of Examples 15-31 can optionally include the carton coding device, which can be configured to apply carton information or other indicia to a carton in a plane that is parallel or substantially parallel to the print position planar transport orientation.

These non-limiting examples can be combined in any permutation or combination.

The above Detailed Description includes references to the accompanying drawings, which form a part of the Detailed Description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." In this document, the term "unassembled" as it relates to a carton is used to refer to an unexpanded carton and/or a carton that is coupled along an edge or corner but which lies substantially flat in a planar configuration. Also, in the following claims, the terms "including" and "comprising" are open-ended, that is, an apparatus, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above Detailed Description is intended to be illustrative, and not restrictive. For example, the above-described examples (or one or more aspects thereof) may be used in combination with each other. Other embodiments can be used, such as by one of ordinary skill in the art upon reviewing the above description. Also, various features or elements may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The Abstract is provided to allow the reader to quickly ascertain the nature of the technical disclosure. It is submitted with the understanding that it will not be used to interpret or limit the scope or meaning of the claims.

The invention claimed is:

1. A method, comprising:

receiving an unassembled carton using a carton transport device in a first planar orientation;

rotating a portion of the carton transport device to rotate the unassembled carton from the first planar orientation to a second planar orientation, which is angled relative to the first planar orientation;

transporting the carton transport device with the unassembled carton at a velocity in a direction parallel or substantially parallel to the second planar orientation; and printing or labeling indicia on the unassembled carton while the carton is being transported.

2. The method of claim 1, further comprising rotating the portion of the carton transport device to rotate the unassembled carton with the indicia from the second planar orientation to an orientation parallel with the first planar orientation.

3. The method of claim 1, wherein receiving the unassembled carton includes removing the unassembled carton from an inventory holder of one or more unassembled cartons using the carton transport device.

4. The method of claim 3, wherein removing the unassembled carton from the inventory holder of one or more unassembled cartons includes removing the unassembled carton using a vacuum-actuated device.

5. The method of claim 3, wherein removing the unassembled carton from the inventory holder of one or more unassembled cartons includes removing the unassembled carton from a stacked inventory of one or more horizontally-oriented unassembled cartons.

6. The method of claim 1, further comprising:

placing the unassembled carton with the indicia in an inventory of printed or labeled unassembled cartons.

7. The method of claim 1, further comprising:

providing, using the carton transport device, the unassembled carton with the indicia to an automated carton assembly device.

8. The method of claim 1, wherein printing or labeling indicia on the unassembled carton includes printing carton information on the unassembled carton such that, when assembled, the carton contains carton information on at least two different carton sides.

9. The method of claim 1, wherein rotating the portion of the carton transport device to rotate the unassembled carton from the first planar orientation to the second planar orientation includes rotating the unassembled carton from a horizontal orientation to a vertical orientation.

10. The method of claim 9, wherein printing or labeling indicia on the unassembled carton includes printing carton information on the unassembled carton using an ink jet print head configured to print within a plane parallel to the second planar orientation.

11. The method of claim 1, wherein rotating the portion of the carton transport device to rotate the unassembled carton from the first planar orientation to the second planar orientation includes rotating the unassembled carton at least about 90 degrees.

12. The method of claim 1, further comprising optically reading or verifying the indicia.

13. The method of claim 1, wherein printing or labeling indicia on the unassembled carton includes transporting the carton transport device with the unassembled carton at a substantially constant velocity parallel to a print plane of one or more print heads that are stationary relative to the carton transport device.

14. A method, comprising:

removing a carton, from an inventory of one or more unexpanded cartons, using a vacuum force;

transporting the carton away from the inventory using a carton transport device;

rotating a portion of the carton transport device to rotate the carton from an initial plane to a print plane, wherein the print plane is non-parallel to the initial plane;

transporting the carton transport device with the carton through a print region including printing indicia on the carton using at least one print head configured to print substantially within the print plane and reading or verifying the printed indicia using an optical scanning device;

rotating the carton from the print plane to the initial plane or a plane parallel with the initial plane; and transporting the carton away from the printing region.

15. A carton processing apparatus, comprising:

a carton transport apparatus, including a carton retrieval device and a conveyor, the carton retrieval device rotatable between a first planar orientation and a second, non-coplanar orientation and movable, using the conveyor, between a first retrieval device location and a second retrieval device location spaced apart from the first retrieval device location;

a carton coding device configured to apply indicia to a surface of a carton retrieved and retained by the carton retrieval device; and a control circuit, communicatively coupled to the carton transport apparatus and the carton coding device, the control circuit configured to provide carton location information to the carton coding device.

16. The carton processing apparatus of claim 15, wherein the carton retrieval device is configured to obtain an unassembled carton in the first planar orientation, and wherein the carton coding device is configured to apply the indicia to the unassembled carton while the carton retrieval device is in the second planar orientation.

17. The carton processing apparatus of claim 15, wherein the carton coding device comprises one or more ink jet print heads.

18. The carton processing apparatus of claim 17, wherein the carton transport apparatus is configured to carry the carton retrieval device in the second planar orientation, and wherein the second planar orientation is parallel to a printing plane of the one or more ink jet print heads.

19. The carton processing apparatus of claim 15, further comprising a carton blank inventory holder;

wherein the carton retrieval device is configured to retrieve, in the first planar orientation, a carton blank from the carton blank inventory holder.

20. The carton processing apparatus of claim 15, wherein the carton coding device is configured to apply unique indicia to at least one side of each of multiple different cartons.

* * * * *